US008878740B2

(12) United States Patent
Coupland et al.

(10) Patent No.: US 8,878,740 B2
(45) Date of Patent: Nov. 4, 2014

(54) HORN ANTENNA FOR A RADAR DEVICE

(75) Inventors: Tim Coupland, Indian River (CA); Gabriel Serban, North York (CA)

(73) Assignee: Siemens Aktiengesellschaft, Munich (DE)

( * ) Notice: Subject to any disclaimer, the term of this patent is extended or adjusted under 35 U.S.C. 154(b) by 249 days.

(21) Appl. No.: 13/333,074

(22) Filed: Dec. 21, 2011

(65) Prior Publication Data

US 2012/0206312 A1 Aug. 16, 2012

(30) Foreign Application Priority Data

Dec. 21, 2010 (EP) ..... 10196206

(51) Int. Cl.
*H01Q 13/00* (2006.01)
*H01Q 1/22* (2006.01)
*H01Q 19/08* (2006.01)

(52) U.S. Cl.
CPC ..... *H01Q 19/08* (2013.01); *H01Q 1/225* (2013.01)
USPC ..... 343/786; 343/773; 343/776

(58) Field of Classification Search
CPC ..... H01Q 13/02; H01Q 9/28; H01Q 21/064
USPC ..... 343/786, 773, 776
See application file for complete search history.

(56) References Cited

U.S. PATENT DOCUMENTS

| | | | | |
|---|---|---|---|---|
| 6,661,389 | B2 | 12/2003 | Griessbaum et al. | |
| 6,859,187 | B2 | 2/2005 | Ohlsson | |
| 7,453,393 | B2 | 11/2008 | Duivenvoorden | |
| 7,999,725 | B2 | 8/2011 | Feisst et al. | |
| 2006/0000274 | A1 * | 1/2006 | Kallsand et al. | 73/290 V |
| 2008/0204351 | A1 * | 8/2008 | Gerding et al. | 343/878 |
| 2009/0178478 | A1 * | 7/2009 | Reimelt et al. | 73/290 V |
| 2009/0212996 | A1 * | 8/2009 | Chen et al. | 342/124 |
| 2010/0066594 | A1 * | 3/2010 | Kienzle et al. | 342/175 |

FOREIGN PATENT DOCUMENTS

| | | |
|---|---|---|
| DE | 102006062223 | 6/2008 |
| WO | WO 03078936 | 9/2003 |

OTHER PUBLICATIONS

Office Action dated Nov. 7, 2013 issued in the corresponding Chinese Patent Application No. 201110433668.1.

* cited by examiner

*Primary Examiner* — Dameon E Levi
*Assistant Examiner* — Collin Dawkins
(74) *Attorney, Agent, or Firm* — Cozen O'Connor

(57) ABSTRACT

A horn antenna for a radar device comprising a metal body having a tubular hollow waveguide section opening into a hollow horn section, a dielectric filling body filling up the inner space of the horn section, and a dielectric cover, wherein the horn antenna is configured to protrude in a measurement environment, protected from highly aggressive process environments and is usable over a wide temperature range.

6 Claims, 1 Drawing Sheet

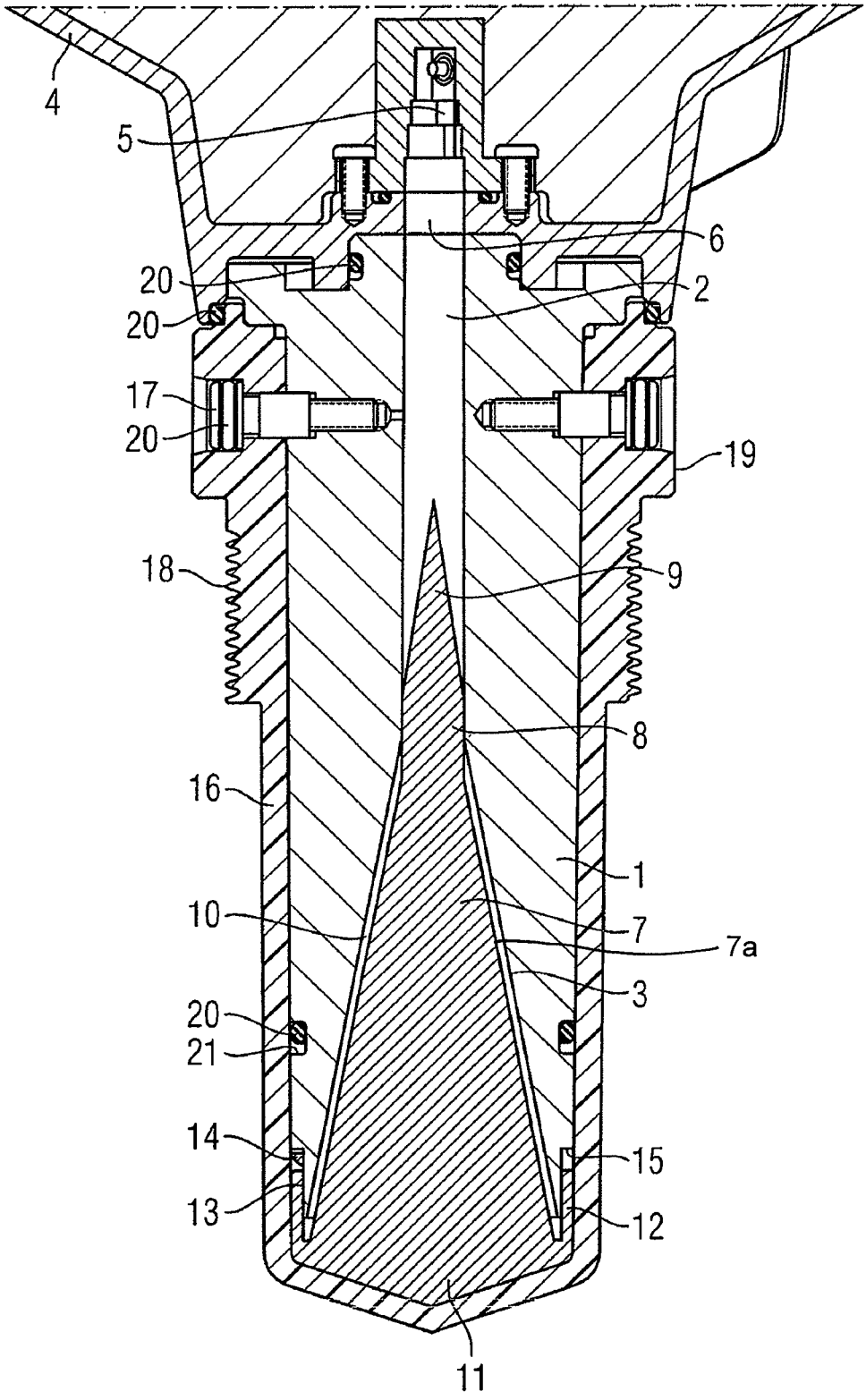
4
5
6
20
2
20
17
20
19
18
9
8
16
1
10
7
7a
3
20
21
14
15
13
12
11

HORN ANTENNA FOR A RADAR DEVICE

BACKGROUND OF THE INVENTION

1. Field of the Invention

The invention relates to radar antennas and, more particularly, to a horn antenna for a radar device comprising a metal body containing a tubular hollow waveguide section which opens into a hollow horn section, a dielectric filling body filling up the inner space of the horn section, and a dielectric cover which is provided surrounding the metal body and covering the filling body at the aperture of the horn section as a protective covering for the horn antenna.

2. Description of the Related Art

FIG. 7 of U.S. Pat. No. 6,661,389 discloses a conventional horn antenna.

In general, microwave pulses, which have been generated by High Frequency (HF) energy coupled in, are radiated by a horn antenna, which also is known as cone antenna. In a combined transmitting and receiving system of a level measuring device equipped with such an antenna, the pulses reflected by a filling product are detected, and the distance from the filling product is assessed by measuring the transit time of these pulses. Radar-based level measuring devices are, for example, used for a continuous level measurement of fluids and/or bulk goods, or a combination of such products.

For antennas that are not exposed to a heavy chemical load, metallic horns or cones preferably of stainless steel are used. For highly aggressive process environments or in applications in which the filling product to be measured is, for purity reasons, not allowed to come in contact with metal, it is known to provide the metallic horn antenna with a protective layer that is corrosion-proof and permeable to microwaves.

FIG. 7 of U.S. Pat. No. 6,661,389 shows a horn antenna comprising a metal body, preferably of aluminum, in which a tubular waveguide section and an adjoining cone-like horn section are formed. The inner space of the horn section is filled with a conical dielectric filling body having a step in the zone of the transition point from the horn section into the tubular waveguide section, so that the tip of the conical filling body presents a slightly different angle with respect to the symmetry axis than the rest of its envelope surface. The metal body and the therein introduced dielectric filling body are completely enclosed by a dielectric cover, here modified polytetrafluoroethylene (PTFE). On the radiation surface where the cover is arranged over the filling body, the cover forms a convex microwave lens. In a portion remote from the radiation surface, the cover is surrounded by a sleeve of synthetic material, which is sealed with the cover by an O-ring. The sleeve is provided with an outer mounting thread so that the entire horn antenna can be screwed into an opening of a flange or vessel.

The problem of different thermal expansions of the hollow horn section and the dielectric filling body is not addressed with respect to the embodiment depicted in FIG. 7 of U.S. Pat. No. 6,661,389.

In FIG. 8, U.S. Pat. No. 6,661,389 additionally discloses another horn antenna where the metal body is screwed in the opening of a mounting flange of a vessel, where the aperture of the horn section is flush with the opening. Here, the dielectric filling body is assembled from three different parts, one of them is formed as a disk that covers and seals the opening against the environment inside the vessel. The other parts are formed as a truncated cone and a pointed cone, where the pointed cone features such an outer dimension that between its outer wall and the inner surface of the horn section a minimal gap remains. As a result, it is possible to proided compensation for expansion variations conditioned by temperature influences.

U.S. 2009/0212996 A1 discloses a horn antenna similar to that aforementioned described conventional horn antennas, with the difference that the dielectric filling body is integrally formed. Here, the dielectric filling body has a cylindrical section that is inserted in the tubular waveguide section and fixed there by a sealing and locking element, thus preventing the filling body from falling out of the horn section of the horn antenna. As the dielectric material of the filling body has a higher coefficient of thermal expansion than the metal body, a circumferential gap is provided between the outer surface of the dielectric filling body and the inner surface of the horn section. An alternative or supplemental sealing and locking element between the filling body and the metal body may be provided in the region of the aperture of the horn section.

The major drawback of the conventional horn antennas disclosed in the U.S. 2009/0212996 A1 and FIG. 8 of U.S. Pat. No. 6,661,389 is that each of these disclosed horn antennas do not protrude into the vessel so that reflections from the mounting flange or the top of the vessel may interfere with the wanted echo from the filling product in the vessel.

The conventional horn antenna depicted in FIG. 7 of U.S. Pat. No. 6,661,389 has the problem in that the hollow horn section and the dielectric filling body have different thermal expansions. The known antenna further shows a two-part design on the process side that may cause sealing and cleaning problems.

SUMMARY OF THE INVENTION

It is therefore an object of the invention to provide a horn antenna that is configured to be arranged so as to protrude in a measurement environment, protected from highly aggressive process environments and usable over a wide temperature range of, e.g., −40° C. to +80° C.

This and other objects and advantages are achieved in accordance with the invention by a horn antenna having a circumferential gap provided between the inner surface of the horn section and the outer surface of the dielectric filling body for compensating different thermal expansions of said dielectric filling body and said horn section.

In accordance with the invention, the dielectric filling body comprises a cylindrical section that is slidably engaged within the tubular waveguide section, and the end portion of the filling body is provided with a collar that extends over the edge of the horn aperture and is supported by at least one spring against a shoulder provided on the metal body, where the spring presses the dielectric filling body against the dielectric cover.

The dielectric filling body is at one end centered in the tubular waveguide section and at the other end by the collar so that the dielectric filling body is movable longitudinally to absorb the differential thermal expansion of the different antenna materials over the whole operating temperature range. The spring presses the filling body against the cover thus mechanically stabilizing the cover and leaving no gap between the filling body and the cover. The spring is in remote position behind the aperture of the antenna and cannot affect the antenna's radiation characteristic.

Preferably, the metal body comprises a circumferential recess into which the collar extends and the bottom of which provides the shoulder for the spring. Thus, there will be no change or at least no abrupt transition from the diameter of collar to the diameter of metal body. As a result, it is easier to apply the cover over the metal body, and the metal body does not constrain the thermal expansion of the cover.

Preferably, the dielectric cover is made of polyvinylidene fluoride (PVDF), which is known for its excellent impervious-ness to aggressive chemicals. The dielectric cover may have an outer mounting thread in a region between the end where the dielectric cover covers the filling body and the opposite end where it is attached to the metal body for mounting the horn antenna into an opening of a vessel or flange. Thus, the points of attachment of the dielectric cover to the metal body are outside the process environment and the horn antenna is hermetically sealed against the process environment. The dielectric cover may be attached to the metal body by shoulder screws that extend through the dielectric cover and into the metal body.

For centering the metal body and the dielectric cover, and for providing a seal to prevent excess condensation from migrating down to the tip of the antenna, the dielectric filling body may have a peripheral groove receiving a seal between the metal body and the dielectric cover.

The dielectric filling body is preferably configured to extend beyond the aperture of the horn section and at this point to form a convex microwave lens. As PVDF as the preferred material of the cover has high dielectric losses at microwave frequencies, the thickness of the PVDF material must be kept at a minimum in the area through which the microwaves are radiated. Therefore, the microwave lens is preferably formed in the dielectric filling body instead of the cover.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will be now described by way of example and with reference to the accompanying drawing, in which:

The FIGURE is a cross sectional view through a horn antenna in accordance with a preferred embodiment of the invention.

DETAILED DESCRIPTION OF THE PREFERRED EMBODIMENTS

The horn antenna depicted in the FIGURE comprises a cylindrical metal body 1, preferably of aluminum, in which a tubular waveguide section 2 and an adjoining cone-like horn section 3 are formed. The metal body 1 is attached to a housing 4 of a radar level transmitter. As known from, e.g., U.S. Pat. No. 7,453,393 B2, a microwave energy signal supplied by a High Frequency (HF) module (not shown) located inside the housing 4 is transferred to a waveguide transition 5 that connects to a short section of a circular waveguide 6 machined in the wall of the housing 4. The microwave energy signal is forwarded to the tubular waveguide section 2 that has the same diameter as the circular waveguide 6. Centering elements are provided to ensure alignment and good electrical contact between the two waveguides 2, 6 to reduce reflections and maximize transferred power. The signal is directed to the horn section 3 from the tubular waveguide section 2.

The horn section 3 is filled with a dielectric filling body 7 that has a conical shape and the same angle as the horn section 3. Suitable dielectric materials include polypropylene (PP), polytetrafluoroethylene (PTFE), Rexolite® and polyethylene (PE). The dielectric cone projects inside the waveguide section 2 with a short cylindrical section 8 to ensure a smooth transition from the empty waveguide section 2 to the filled horn section 3, thus realizing a filled wave-guide section, and ends with a conical tip 9 with a length optimized to produce minimal reflections. The cylindrical section 8 is slidably engaged within the tubular waveguide section 2 and also serves as centering device for the dielectric filling body 7.

A circumferential gap 10 is provided between the inner surface of the horn section 3 and the outer surface 7*a* of the dielectric filling body 7, which allows for free longitudinal movement of the filling body 7 to compensate for differences between the linear thermal expansion of the filling body 7 and the metal body 1. The dielectric filling body 7 extends beyond the aperture of the horn section 3 and forms at this location a convex microwave lens 11. In this area, the filling body 7 features a collar 12 that extends over the edge of the horn aperture and back into a circumferential recess 13 in the outside of the cylindrical metal body 1. The collar 12 is here supported via a spring 14 comprising a wave shaped washer or wavy washer against a shoulder 15 formed by the bottom of the recess 13. At this location, the spring 14 is hidden from the aperture of the antenna and cannot affect the radiation characteristic of the antenna.

The horn antenna is protected outside against the process environment by a cover 16 made from a plastic material impervious to aggressive chemicals. Different materials may be used, but the best material known at this time is polyvinylidene fluoride (PVDF). The cover 16 surrounds the metal body 1 and covers the portion of the filling body 7 that extends beyond the aperture of the horn section 3. In an area close to the housing 4 and thus remote from the horn aperture, the cover 16 is attached to the metal body 1 by shoulder screws 17 that radially extend through the dielectric cover 16 into the metal body 1. The cover 16 has an outer mounting thread 18 and a hexagonal profile 19 to allow threading in a region between its attachment to the metal body 1 and the horn aperture. Consequently, the screws 17 are outside the process environment and the horn antenna is hermetically sealed against the process environment.

O-rings 20 are placed at all radar housing/horn/cover interfaces for sealing the antenna internals against outside conditions. One O-rings 20 is placed between the dielectric cover 16 and the metal body 1 in a peripheral groove 21 of the metal body 1.

PVDF as the preferred material of the cover 16 has high dielectric losses at microwave frequencies so that its thickness must be kept at a minimum in the area through which the microwaves are radiated. This is also a reason why the microwave lens 11 is formed in the dielectric filling body 7, and not in the cover 16. Mechanical strength of the PVDF cover 16 at the antenna aperture is provided by backing it with the dielectric filling body 7 that is pressed against the cover 16 by the wave shaped or wavy washer 14. The dielectric filling body 7 is at one end centered in the tubular waveguide section 2 and at the other end by the collar 12 in the recess 13 of the cylindrical metal body 1. The dielectric filling body 7 is therefore moveable longitudinally to absorb the differential thermal expansion of the different antenna materials over the entire operating temperature range. The differential thermal expansion between plastics and metals is a big challenge for a horn antenna. For a metal body 1 made of aluminum, with a typical length of 100 mm, covered with PVDF and filled with polypropylene, and a temperature range −40° C. to +80° C., the PVDF cover 16 will expand by approx. 1.6 mm, polypropylene by approx. 1.0 mm and aluminum by only 0.25 mm.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A horn antenna for a radar device comprising:

a metal body containing a tubular hollow waveguide section opening into a hollow horn section and containing a circumferential recess at an outside of the metal body, a bottom of the circumferential recess providing a shoulder;

a dielectric filling body filling up the inner space of the hollow horn section, the dielectric filling body comprising a cylindrical section slidably engaged within the tubular hollow waveguide section;

a dielectric cover surrounding the metal body and covering the filling body at an aperture of the horn section to form a protective covering of the horn antenna, the dielectric cover further including a collar provided at an end portion of the dielectric filling body, the collar extending over an edge of the hollow horn aperture and further extending back toward the shoulder provided by the bottom of the circumferential recess;

an inner surface of the hollow horn section and an outer surface of said dielectric filling body having a circumferential gap therebetween, the circumferential gap providing compensation for different thermal expansions of said dielectric filling body and said hollow horn section; and at least one spring supporting the end portion of the dielectric filling body against the shoulder, said spring pressing the dielectric filling body against the dielectric cover.

2. The horn antenna according to claim 1, wherein the dielectric cover comprises polyvinylidene fluoride (PVDF).

3. The horn antenna according to claim 1, wherein the dielectric cover includes an outer mounting thread in a region between an end at which the dielectric cover covers the filling body and an opposite end at which the dielectric cover is attached to the metal body.

4. The horn antenna according claim 3, wherein the dielectric cover is attached to the metal body by shoulder screws extending through the dielectric cover and into the metal body.

5. The horn antenna according to claim 1, wherein the metal body includes a peripheral groove receiving a seal between the metal body and the dielectric cover.

6. The horn antenna according to claim 1, wherein the dielectric filling body forms a convex microwave lens at its end remote from the cylindrical section.

* * * * *